United States Patent [19]

Hammett

[11] Patent Number: 4,920,928

[45] Date of Patent: May 1, 1990

[54] MOMENTUM ENGINE

[76] Inventor: Robert B. Hammett, 107 Riverdale Dr., Covington, La. 70433

[21] Appl. No.: 121,066

[22] Filed: Oct. 13, 1987

Related U.S. Application Data

[63] Continuation-in-part of Ser. No. 801,423, Nov. 25, 1985, abandoned, which is a continuation of Ser. No. 583,665, Feb. 27, 1984, abandoned.

[51] Int. Cl.[5] ..... F01B 11/00

[52] U.S. Cl. ..... 123/46 SC; 123/46 R; 123/65 E

[58] Field of Search ..... 123/46 R, 46 A, 46 SC, 123/65 E, 65 WV

[56] References Cited

U.S. PATENT DOCUMENTS

| | | | |
|---|---|---|---|
| 79,938 | 7/1868 | Babbitt | 123/46 A |
| 735,863 | 8/1903 | Duryea et al. | 123/46 A |
| 1,036,288 | 8/1912 | Matricardi | 123/46 A |
| 1,920,765 | 8/1933 | Rasch | 123/46 R |
| 2,056,293 | 10/1936 | Rasch | 123/46 R |
| 2,102,559 | 12/1937 | Kadenacy | 123/65 E |
| 2,140,205 | 12/1938 | Haage | 123/65 E |
| 2,168,528 | 8/1939 | Kadenacy | 123/65 E |
| 2,206,632 | 7/1940 | Cornish et al. | 123/65 E |
| 2,435,970 | 2/1948 | Lewis | 123/46 R |
| 2,976,860 | 3/1961 | Bayer | 123/46 R |
| 2,991,765 | 7/1961 | Lang | 123/46 SC |
| 2,995,122 | 8/1961 | Randall | 123/46 R |
| 3,610,215 | 10/1971 | Carter | 123/46 R |

*Primary Examiner*—Willis R. Wolfe

[57] ABSTRACT

A free-piston engine in which combustion gas is conducted around a piston for a short time during the expansion stroke. The resulting lowered pressure enables intaking in the final part of this stroke. Pressure from the gas conducted around the piston serves as the piston rebounding force and as the engine output.

31 Claims, 3 Drawing Sheets

MOMENTUM ENGINE

This application is a continuation-in-part of application Ser. No. 801,423 filed Nov. 25, 1985, now abandoned, which was a continuation of Ser. No. 583,665 filed Feb. 27, 1984, now abandoned.

FIELD OF THE INVENTION

This invention relates to cyclic internal combustion engines and their processes, and particularly engines whose output is gas under pressure such as the free-piston.

BACKGROUND OF THE INVENTION

Previous similar free-piston engines have output gas from their combustion chamber at the end of the expansion stroke and utilizes supercharging to force gas into the combustion chamber against the output pressure in a conventional two-stroke cycle. These engines have also generally required a separate bounce chamber to rebound the piston at the end of the stroke. The need of supercharging and bounce chamber have added significantly to the complexity of these engines.

SUMMARY OF THE INVENTION

An object of this invention is a high efficiency engine.

Another object of this invention is a engine cycle wherein the combustion chamber is exhausted part-way into the expansion stroke.

Another object of this invention is a high compression engine which applies only easily managed stresses to its component parts.

Another object of this invention is an engine capable of durable operation without conventional oiling or cooling.

Another object of this invention is an engine readily made from non-metallic materials.

Further objects and advantages of this invention will become apparent from a consideration of the drawings and ensuing description.

DETAILED DESCRIPTION

Figure 1:
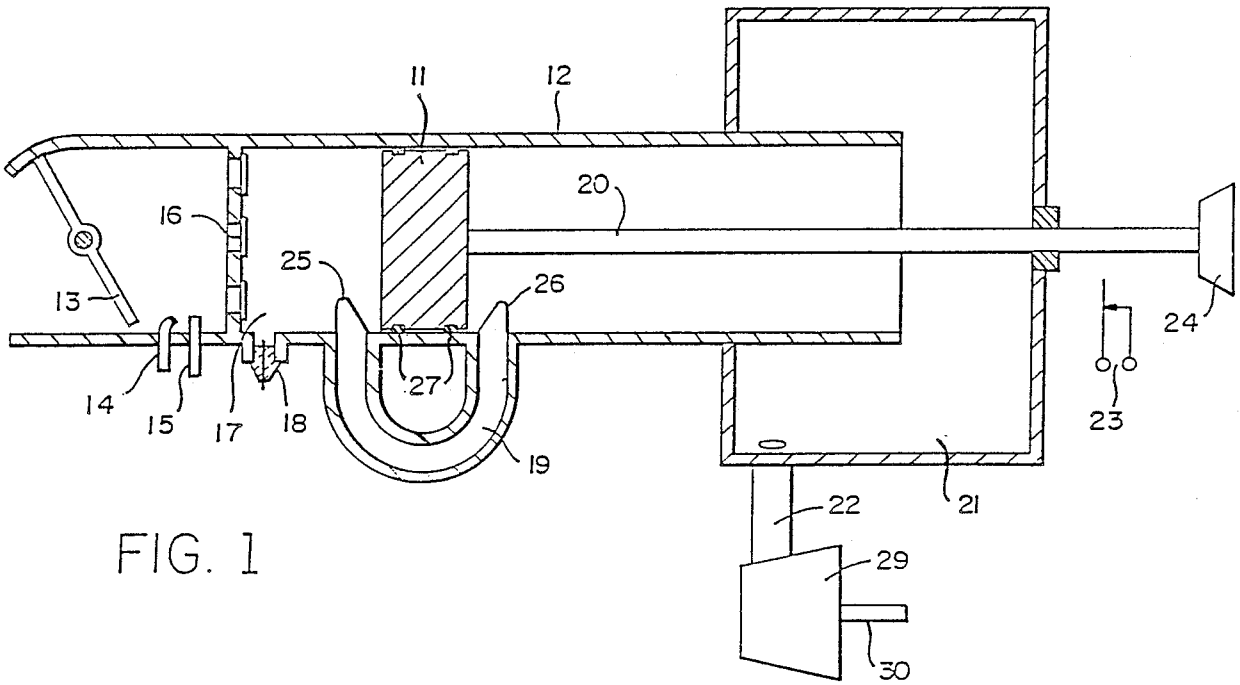
FIG. 1 is a schematic cross-sectional illustration of a single piston engine of the present invention.

Referring to FIG. 1, the piston 11, which is attached to rod 20, is fitted to the cylindrical casing 12. Starting air jet 14 provides an aerosol of fuel from the fuel jet 15, through the reed check valve 16, and into the combustion chamber 17. Spark plug 18 is fired on the opening of the breaker points 23 by the inward travel of the rod head 24. Inertial channel 19 connects casing 12, wall port 25, and port 26. Inertial channel 19 and ports 25 and 26 can also be composed of a slot in the casing 12 when passed over by the piston 11. Such a slot can be spiraled around inside the casing 12 to achieve the desired length. Rings 27 limit leakage of gas across the piston 11. Receiver 21 collects and smooth pressure fluctuations of the gas, which are then delivered by pipe 22 to the turbine 29, whose whose work output is from the rotating shaft 30.

Figure 2:
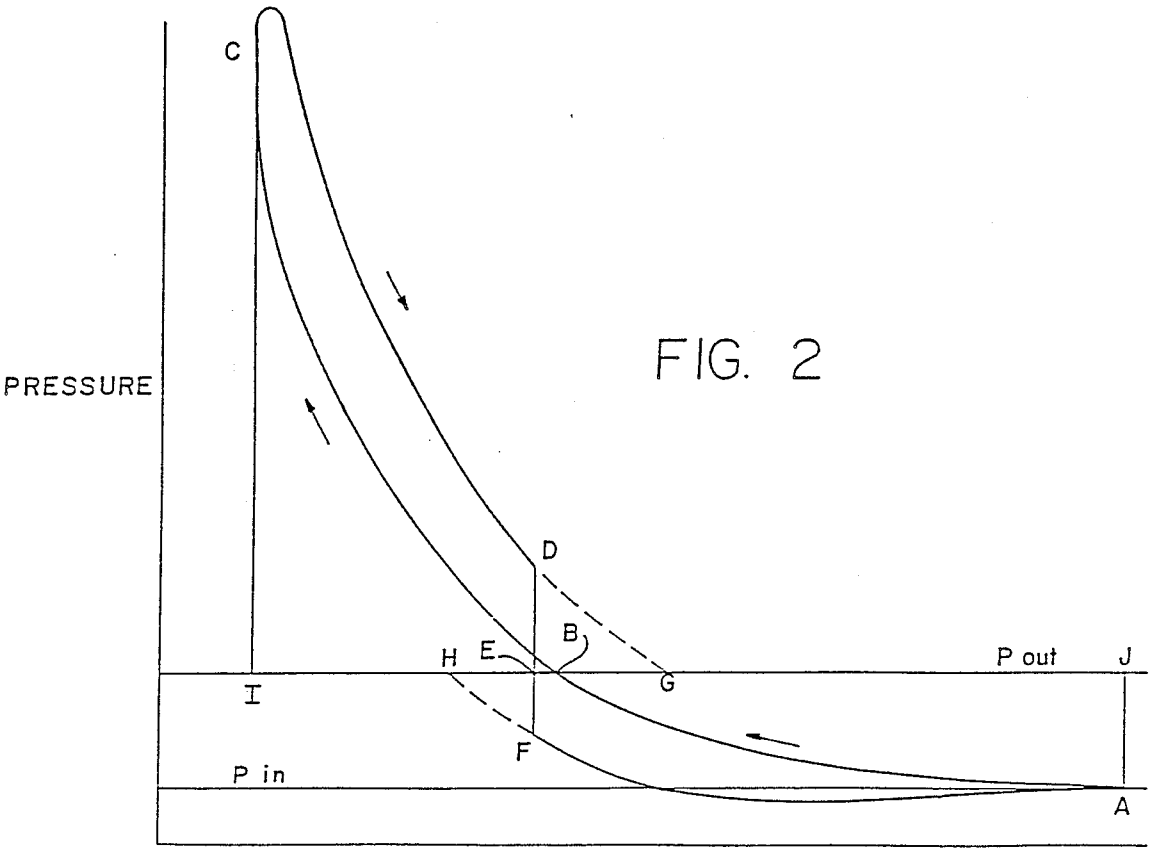
FIG. 2 is a pressure-volume curve of an engine of the present invention.

Starting is accomplished by forcing the rod head 24 inward, driving the piston 11 to compress fuel air mixture in the combustion chamber 17, and opens breaker 23, firing the spark 18. The high pressure of combustion, C in FIG. 2 causes the piston 11 to move outward and opening the port 25 at D in FIG. 2, where the gas pressure DE causes flow through the inertial channel 19. The work available to cause this high speed flow is the area DGE. This flow once set in motion continues causing a further drop in pressure from E to F. The work done in this pumping is the area HEF. Area DGE is greater than area HEF to make up for throttling and flow losses and at high power levels shock losses. At point F, the continued travel of the piston 11 closes port 26 and further expansion FA is carried on by the piston 11 until the pressure is lowered below P-in, opening valves 16, admitting new air. The piston 11 stops its outward travel when the kinetic energy acquired by the piston 11 in the initial expansion CDEI is used up in traveling against P-out, area EFAJ. The piston 11 then begins the compression stroke driven by the work represented by the area JAB, which then becomes the compression work BIC. Combustion then occurs completing the cycle.

The volume of the inertial channel 19 is sufficient that the pumping work HEF can be a achieved by the kinetic energy of the gas mass in this channel's volumne traveling at less than the local speed of sound. The length of the inertial channel 19 is such that the time taken to accelerate and decelerate the gas column is equal to the time between the opening of port 25 by the piston 11 and the closing of port 26 by the piston 11. The piston speed crossing the ports is determined by the mass of the piston 11 and rod 20 acted on by the expansion work ICDE. To minimize throttling losses, the port 25 should extend along the opening edge of piston 11 as far as possible consistent with a shape having low flow losses. This enables an abrupt valving action, which quickly bring the whole pressure DE to bear, accelerating the gas in the inertial channel.

Figure 3:
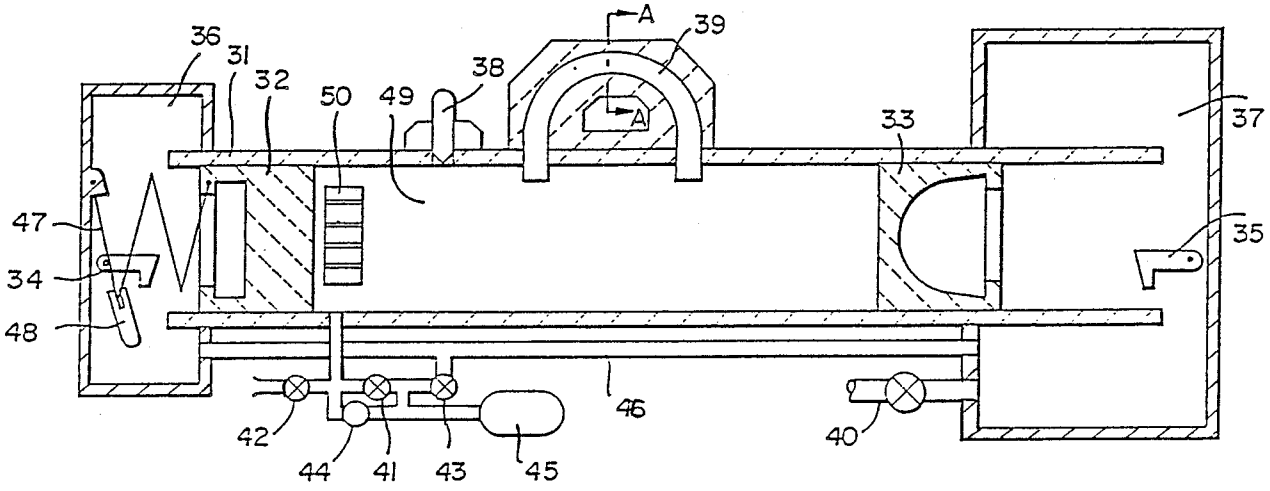
FIG. 3 is a schematic cross-sectional illustration of a dual-piston engine of the present invention.

Referring to FIG. 3, ceramic cylindrical casing 31 contains the heavy ceramic piston 32 and the light ceramic piston 33. The velocity and stroke of the counterbalancing, oppositely moving pistons are inversely proportionate to their masses. Spring 47, whose force is light when compared to the air pressure forces, maintains the reciprocating pistons in the same lengthwise position in the casing 31. Intake port with non-return reed valve 50 and conduit 40 for valves 41, 42, and 44 pass through the casing 31. For starting, air from tank 45 through valve 41 enters the combustion chamber 49 side of the pistons driving the pistons apart, which engage pawls 34 and 35. Valve 42 then releases air from between pistons. With valve 40 closed, valves 43 then pressurizes receivers 36 and 37 through pipe 46. Pipe 46, which keeps the pressure in the receivers 36 and 37 equal, can also be equipped to utilize pressure fluctuation to apply a relatively small pressure differential between receivers 36 and 37 moving the combustion position in the casing 31. Pawls 34 and 35 then release pistons which accelerate inward. Electrical fuel pumping means not shown receives a signal from sensor 48 measuring the inwardness of piston 32 to determine the point for fuel pumping through the injector 38. Channel 39 permits flow bypassing the piston 33. Non-return valve 44 enables recharging of the tank 45.

Figure 4:
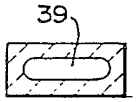
FIG. 4 is a cross-section view A—A of the channel 39 of FIG. 3.

FIG. 4 shows the cross-section of the channel 39 which is adapted to fast valving action by the piston 33.

Figure 5:
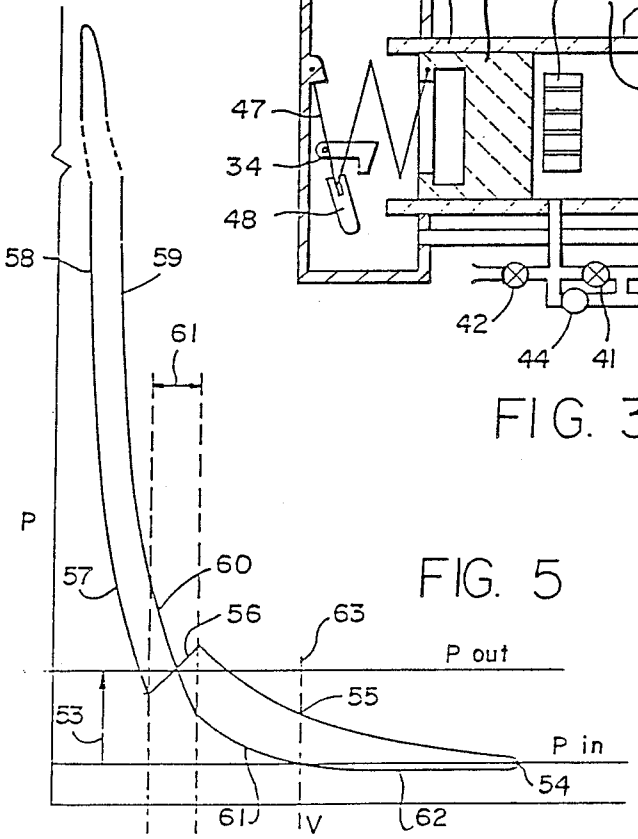
FIG. 5 is a pressure-volume curve of an engine of the present invention.

Referring to FIG. 5, arrow 53 represents the starting pressurization of the receivers 36 and 37. The initial inward movement of the pistons which compresses 55 air between the pistons continues till the channel 39 opens, when air flows around piston 33 through the channel 39. The channel 39 is open for flow when the volume between pistons is between the dotted lines 61. This flow is represented by curve 56, which inertially continues below P-out the pressure of receiver 37 utilizing the kinetic energy of the flow. This spill 56 of gas from the combustion chamber 49 serves to stabilize the quantity of gas compressed for combustion. The momentum of the pistons continues the compression 57, fuel is injected at 58 from the injector 38, combustion further increasing the pressure. The pressure due to compression and combustion stops and turn the pistons into the initial expansion 59 which continues until the channel 39 opens and blowdown-scavenge 60 results. The outward momentum of the piston continues 61. Piston 32 uncovers the intake 34 at 63 and air is drawn in when the pressure between the pistons goes below P-in 62. This intaking continues until the outward momentum of the pistons is exhausted 54; and the whole cycle repeats. Output of gas at pressure P-out is available from valve 40 to such as a turbine.

Figure 6:
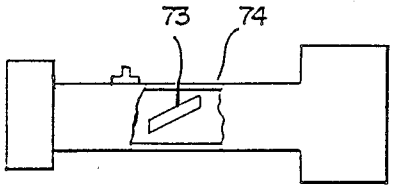
FIG. 6 is a partially sectioned outline view of an embodiment of the present invention.

FIG. 6 shows a spiral slot 73 in the casing 74, which when covered by the piston 32, forms a channel to permit flow around the piston 33. The spiraling about the casing of a channel lessens flow losses due to turning gas out and back into the casing while achieving the desired length. To reduce side-force on the piston, a second channel 180-degrees around the casing from the first can be employed to balance pressure on the piston. Similarly, groves circling the outside of the pistons will equalize pressure side-forces. The channel can also be annularly extended completely around the casing.

While the above description contains many specificities, these shoud not be construed as limitations on the scope of the present invention but exemplifications of details of construction and arrangement of parts. Many other variations are possible.

I claim:

1. Apparatus generating pressurized gas from the combustion of fuel comprising:

a piston fitted to a casing, said piston being able to accelerate when acted on by gas pressure;

a chamber to one side of said piston providing for the combustion of fuel;

a first port in said casing being opened by the travel of said piston;

a second port in said casing being closed by the further travel of said piston;

and a channel communicating said first port to said second port so that the closure of said second port by said piston prevents flow in said channel.

2. Apparatus as in claim 1 further including a reciever communicating with the opposite side of said piston from said chamber and collecting gas released by said first port.

3. Apparatus as claimed in claim 1 where the channel communicating said first port to said second port is an inertial channel proportioned to pump substantial gas from said chamber.

4. Apparatus as claimed in claim 1 where said first port is shaped to abruptly initiate the release of gas from said chamber.

5. Apparatus as claimed in claim 4 where the channel communicating said first port to said second port is an inertial channel proportioned to pump substantial gas from said chamber.

6. Apparatus as claimed in claim 1 where said channel is formed between said piston and said casing.

7. Apparatus as claimed in claim 2 where the forces acting on said piston are the forces in said chamber on one side of said piston and the substantially constant pressure of the said receiver on the other side of said piston.

8. An apparatus for effecting a thermodynamic cycle comprising:

a piston fitted to a casing and moving in said casing in response to gas pressure difference between sides of said piston;

a chamber located to one side of said piston providing for the containment of gas under pressure;

means to release gas from the chamber side of said piston after an initial expansion of gas by said piston;

means to utilize energy of said released gas to pump gas from said chamber;

a further expansion by said piston of gas remaining in said chamber after said pumping of said chamber;

and means to return said piston at one extreme of said piston's movement in said casing.

9. Apparatus as claimed in claim 8 where the means to return said piston receives gas from said releasing means.

10. Apparatus as claimed in claim 8 where the means for releasing gas comprises an inertial channel proportioned to pump substantial gas from the chamber side of said piston.

11. Apparatus as claimed in claim 10 where the said means to release gas is shaped to abruptly initiate said release of gas

12. Apparatus as claimed in claim 11 where the means to return said piston receives gas from the inertial channel.

13. Apparatus as claimed in claim 8 where said gas pressure difference moving said piston is the said chamber's pressure on one side of said piston and a substantially constant pressure on the other side of said piston.

14. Apparatus as claimed in claim 8 where said release of gas is stopped by the covering of a port in said casing by said piston.

15. Apparatus as claimed in claim 8 where the output is gas under pressure from said releasing means.

16. The method of executing a thermodynamic cycle comprising:

the drawing in of air for compressing;

the compression of said drawn in air;

means increasing the pressure of said compressed air;

an initial expansion of said pressured compressed air;

a further expansion by a gas momentum generating process through an unthrottled opening;

a process utilizing said generated gas momentum to pump air from a lower to a higher pressure;

and a final piston expansion drawing in air for the next compression.

17. Apparatus generating pressurized gas from the combustion of fuel comprising;

a casing having two piston disposed to sides of a chamber in said casing;

said casing also having an inlet passage for said chamber;

an initial expansion of gas by the pistons from their inward position following combustion in said chamber;

a bypass passage opened by one of said pistons after said initial expansion;

said bypass passage being closed by the further travel of one of said pistons;

a further expansion of gas after said passage is closed; and means to rebound said pistons toward their said inward position.

18. Apparatus as claimed in claim 17 where said inlet passage has a non-return valve.

19. Apparatus as claimed in claim 17 wherein said inlet passage is blocked by one of said pistons when said pistons are in their inward position.

20. Apparatus as claimed in claim 19 where said inlet passage has a non-return valve.

21. Apparatus as claimed in claim 20 where said inlet is unblocked during a substantial part of the expansion stroke.

22. Apparatus as claimed in claim claim 17 where part of the gas in said chamber is released through said passage during the compression stroke.

23. Apparatus as claimed in claim 17 where said released gas is said rebound means.

24. Apparatus as claimed in claim 17 where the said bypass passage is proportioned to inertially pump substantial gas from said chamber.

25. Apparatus as claimed in claim 17 where said two pistons are of substantially different masses.

26. Apparatus as claimed in claim 17 where the forces controlling the movement of one of said pistons is said chamber's pressure on one side and a substantially constant pressure on the other.

27. Apparatus as claimed in claim 8 where said passage is formed between said casing and one of said pistons.

28. Apparatus as claimed in claim 8 where said passage is in the shape of a spiral about said casing.

29. In a free-piston engine having a casing fitting two pistons for the compression and expansion of gas;

a port in said casing for the passage of gas; in relationship to each other, one of said two pistons is light while the other is heavy;

the light piston's mass is selected to provide a stroke greater than said light piston's length in response to the pressures of said compression and expansion of gas, thereby providing substantial compression and expansion;

while the heavy piston's mass is selected to provide a stroke less than said heavy piston's length in response to the pressures of said compression and expansion of gas, thereby providing substantial coverage of said port in said casing.

30. Apparatus as claimed in claim 29 further providing a passage bypassing around one said of said pistons.

31. Apparatus as claimed in claim 28 where the forces controlling the movement of one of said piston is the pressure of said compression and expansion on one side and a substantially constant pressure on the other.

* * * * *